US006065865A

United States Patent [19]

Eyraud et al.

[11] Patent Number: 6,065,865

[45] Date of Patent: May 23, 2000

[54] MAGNETICALLY DRIVEN AGITATOR WITH MAGNETIC ROTATION DETECTOR

[75] Inventors: Philippe Eyraud, Dardilly; Guy Flavien, Collonges au Mont D'Or., both of France

[73] Assignee: Mixel, Dardilly, France

[21] Appl. No.: 09/325,875

[22] Filed: Jun. 4, 1999

[30] Foreign Application Priority Data

Jun. 5, 1998 [FR] France ..... 98 07259

[51] Int. Cl.[7] ..... B01F 13/08

[52] U.S. Cl. ..... 366/273; 366/314

[58] Field of Search ..... 366/142, 262–265, 366/273, 274, 314, 331; 416/3

[56] References Cited

U.S. PATENT DOCUMENTS

| | | | |
|---|---|---|---|
| 2,810,556 | 10/1957 | Zozulin | 366/274 |
| 3,694,341 | 9/1972 | Luck, Jr. . | |
| 3,730,488 | 5/1973 | Gardner, Jr. . | |
| 4,209,259 | 6/1980 | Rains et al. | 366/273 |
| 4,993,841 | 2/1991 | Lofgren et al. | 366/274 |
| 5,061,079 | 10/1991 | Shiobara | 366/273 |
| 5,393,142 | 2/1995 | Meier | 366/314 |
| 5,407,272 | 4/1995 | Meier | 366/274 |
| 5,470,152 | 11/1995 | Rains | 366/273 |
| 5,478,149 | 12/1995 | Quigg | 366/314 |
| 5,533,803 | 7/1996 | Meier | 416/3 |
| 5,684,712 | 11/1997 | Goffe et al. | 366/274 |
| 5,758,965 | 6/1998 | Gambrill et al. | 366/273 |
| 5,779,359 | 7/1998 | Gambrill et al. | 366/331 |

FOREIGN PATENT DOCUMENTS

| | | | |
|---|---|---|---|
| 360767 | 3/1990 | European Pat. Off. | 366/273 |
| 399971 | 9/1990 | European Pat. Off. | 366/273 |
| 399972 | 11/1990 | European Pat. Off. | 366/273 |
| 0617999 | 10/1994 | European Pat. Off. . | |
| 3039810 | 5/1982 | Germany | 366/273 |
| 60-125240 | 7/1985 | Japan | 366/273 |
| 63-31528 | 2/1988 | Japan | 366/273 |
| 63-36825 | 2/1988 | Japan | 366/273 |
| 64-56127 | 3/1989 | Japan | 366/273 |
| 1-130722 | 5/1989 | Japan | 366/273 |
| 6-190258 | 7/1994 | Japan | 366/273 |

*Primary Examiner*—Charles E. Cooley
*Attorney, Agent, or Firm*—Dowell & Dowell, P.C.

[57] ABSTRACT

A magnetically driven agitator for a mixture contained in a recipient which agitator is supported by a collar hermetically mounted in a wall of the recipient and which collar is provided with a blind sleeve inside which is housed a drive shaft provided with a first magnetic coupling. A propelling screw is disposed around the blind sleeve and is provided with a second magnetic coupling adapted to cooperative with the first magnetic coupling for driving the propelling screw about an axis of rotation. A third magnetic element carried by the propelling screw is disposed opposite a cell for detecting the movement of the third coupling element during rotation of the propelling screw about the axis of rotation.

10 Claims, 2 Drawing Sheets

4
2

1
3
II
8
7
8
2a
35
34
PROCESSING UNIT
6
5
9

MAGNETICALLY DRIVEN AGITATOR WITH MAGNETIC ROTATION DETECTOR

BACKGROUND OF THE INVENTION

1. Field of the Invention

The present invention relates to a magnetically driven agitator.

2. Brief Description of the Related Art

Agitators are conventionally used for stirring a mixture contained inside a recipient in order to avoid a decantation or any other alteration of the mixture in the course of time. A magnetically driven agitator presents the advantage that the propelling screw that it comprises is set in motion by a magnetic coupling which takes place without physical contact between two rotating parts, such as the driven shaft of an electric motor and the propelling screw which is associated therewith. This makes it possible to dispose this shaft outside the recipient while the propelling screw is installed inside the recipient. Any danger of leakage at the level of the agitator may thus be set aside. This is particularly useful when the mixture is toxic or when pollution thereof by outside agents must be avoided, such as for example in the case of a medicinal composition.

In the known devices, this absence of mechanical connection between the drive shaft and the propelling screw may lead to errors in manipulation or blockages which cannot be revealed before the recipient is completely emptied. For example, an operator may forget to install the propelling screw inside the recipient while the shaft for moving the propelling screw is rotating normally, and one might be led to believe that the agitator is performing its function. As a mixture can be stirred for a relatively long period of time, of the order of several days and even of several weeks, if this omission is discovered at the end of manipulation, numerous working hours are lost, as well as a high value-added product. Similarly, it may happen that a propelling screw is jammed, particularly due to the non-homogeneous nature of the mixture contained in the recipient. Such a jamming is not detected by a corresponding jamming of the shaft since the latter is not mechanically connected to the propelling screw.

In order to overcome the problems set forth above, it may be envisaged to install a sensor, for example a capacitive one, in the vicinity of the agitator. The installation of such a sensor would require an additional bore in the wall of the recipient, which would increase the risks of leakage and poor cleaning and would necessitate precise operations for positioning and adjusting this sensor with respect to the propelling screw inside the recipient, i.e. in a zone of reduced access. This would result in the device being overpriced.

It is a particular object of the invention to overcome these drawbacks by proposing a magnetically driven agitator in which a defective rotation of the propelling screw can be immediately detected without it being necessary to make additional bores in the wall of the recipient.

SUMMARY OF THE INVENTION

To that end, the invention relates to a magnetically driven agitator for a mixture contained in a recipient, this agitator being supported by a collar hermetically mounted in a wall of the recipient and provided with a blind sleeve inside which is housed a drive shaft provided with a first magnetic coupling means, while a propelling screw disposed around this sleeve is provided with a second magnetic coupling means adapted to cooperate with the first magnetic coupling means for driving the propelling screw about an axis of rotation,. This agitator is characterized in that the propelling screw is secured to a third magnetic coupling means, disposed opposite a cell for detecting the passage of the third coupling means, this cell being carried by the collar.

Thanks to the invention, the cooperation of the third magnetic coupling means and the cell makes it possible to detect the effective movements of rotation of the propelling screw and, on the contrary, an absence of the propelling screw or blocking thereof. As the cell is carried by the collar, it may be pre-assembled thereon before the collar is positioned in the corresponding orifice of the recipient, with the result that the positioning of the propelling screw with respect to the cell may be adjusted with precision, under optimal conditions for an operator. No additional bore is necessary for positioning the detection cell, which is a safety factor with respect to the tightness of the recipient.

The invention goes against a common prejudice in the field of magnetic agitators, whereby the intensity of the magnetic field used for driving the propelling screw in rotation, i.e. of the intense magnetic field prevailing between the first and second magnetic coupling means, would be such as to disturb the measurements made thanks to a magnetic field in the vicinity of these coupling means. In effect, it has been determined experimentally that the magnetic field prevailing between the first and second magnetic coupling means is closed at the level of these means, with the result that it does not disturb the coupling made between the third magnetic coupling means and the detection cell, including when this third coupling means is disposed in the immediate proximity of the first and second coupling means.

According to a first advantageous aspect of the invention, the third magnetic coupling means comprises at least one permanent magnet. Such a permanent magnet is of restricted dimensions and cost, with the result that it does not risk unbalancing the propelling screw or affecting the economic performances of the device.

According to another advantageous aspect of the invention, the air gap between the third coupling means and the detection cell is substantially perpendicular to the axis of rotation of the propelling screw. This aspect of the invention limits very substantially the interferences between the magnetic field for drive, created between the first and second magnetic coupling means, and the magnetic field for detection or measurement, created between the third coupling means and the cell.

In that case, it may be provided that the first and second coupling means form a magnetic field extending in an essentially radial direction about the axis of rotation of the propelling screw, the magnetic field created between the third coupling means and the detection cell being substantially parallel to this axis of rotation.

In particular, the second and third coupling means may be mounted on a bush placed around the blind sleeve, the third coupling means being oriented towards the detection cell.

According to another advantageous aspect of the invention, the first and second magnetic coupling means each comprise a permanent magnet of which the direction of bias is oriented radially with respect to the sleeve. In that case, and when the third coupling means comprises a permanent magnet, the magnet of the third magnetic coupling means is disposed so that its direction of bias is substantially perpendicular to the direction of bias of the magnets of the first and second coupling means.

According to another advantageous aspect of the invention, the output signal of the detection cell is furnished to a processing unit adapted to determine from this signal, by computing, the speed of rotation of the propelling screw. In this way, the device of the invention can perform a function both of monitoring an effective rotation of the propelling screw and of speed indicator.

According to another advantageous aspect of the invention, the collar comprises a blind housing for accommodating the detection cell, the opening of this housing facing the outside of the collar. This aspect of the invention guarantees that the detection cell can in no case be in direct contact with the mixture contained in the recipient, this avoiding any risk of pollution of the mixture or of soiling the cell.

According to another advantageous aspect of the invention, the propelling screw comprises a plurality of blades distributed around a bush and a head provided with a plurality of arms supporting this bush, an annular space being arranged between the arms and a terminal part of the sleeve forming a bearing. This annular space facilitates cleaning of the propelling screw mounted on the blind sleeve.

BRIEF DESCRIPTION OF THE DRAWINGS

The invention will be more readily understood on reading the following description of an embodiment of a magnetically driven agitator in accordance with its principle, given solely by way of example and made with reference to the accompanying drawings, in which.

DESCRIPTION OF PREFERRED EMBODIMENT

Figure 1:
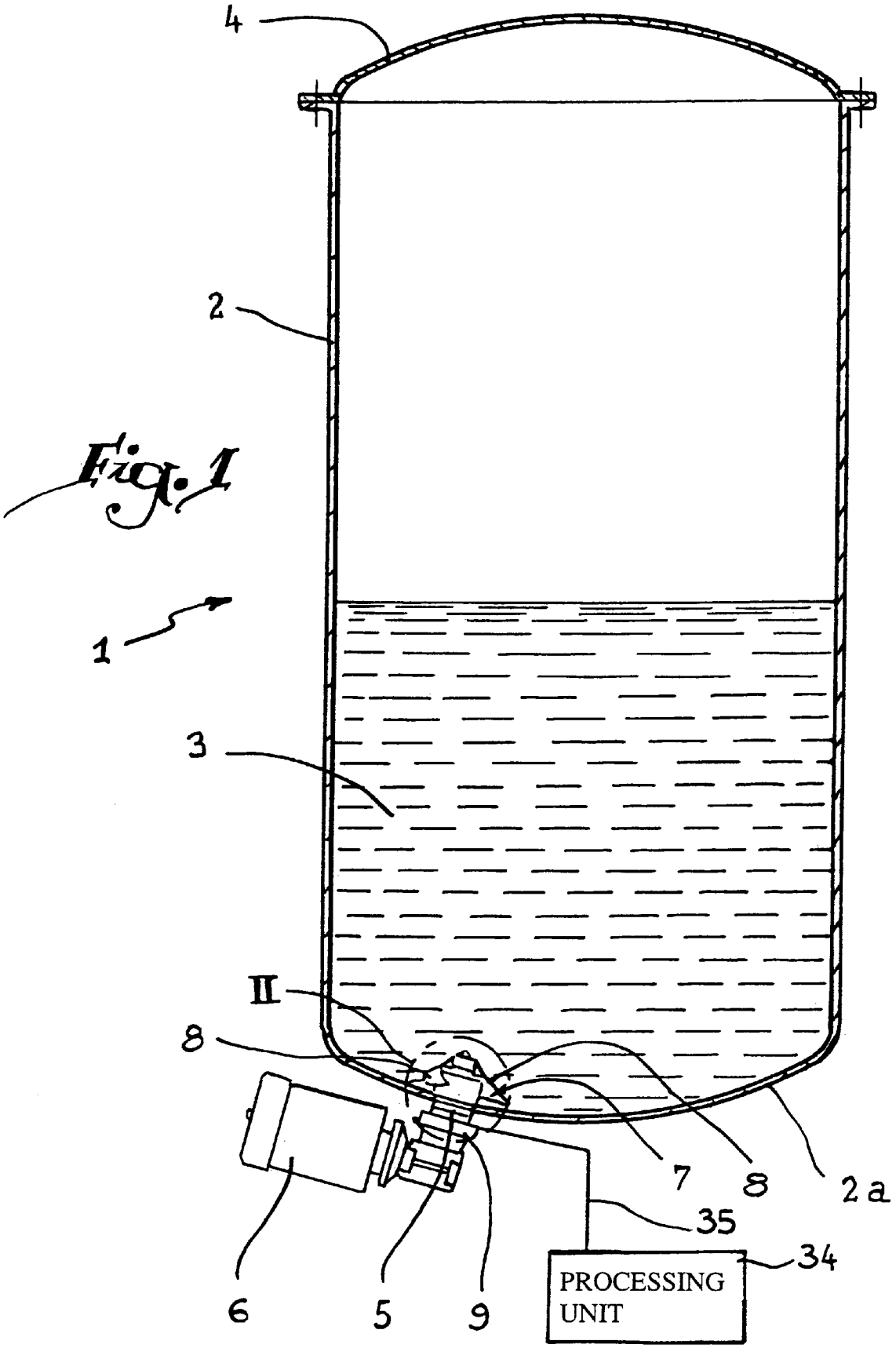
FIG. 1 schematically shows a recipient for mixtures equipped with an agitator according to the invention.

Referring now to the drawings, and firstly to FIG. 1, a recipient 1 is formed by a tank 2 containing a mixture 3, while a lid 4 is provided to close an upper opening of the tank. In the bottom wall 2*a* of the tank 2 there is disposed a collar 5 made of a magnetic material supporting a magnetic agitator comprising an electric drive motor 6, located outside the tank 2, and a propelling screw 7 disposed inside the tank in the mixture 3. Rotation of the screw 7 by the electric motor 6 results in a displacement of its blades 8 about an axis of rotation X-X', which has for its effect to stir the mixture 3.

Figure 2:
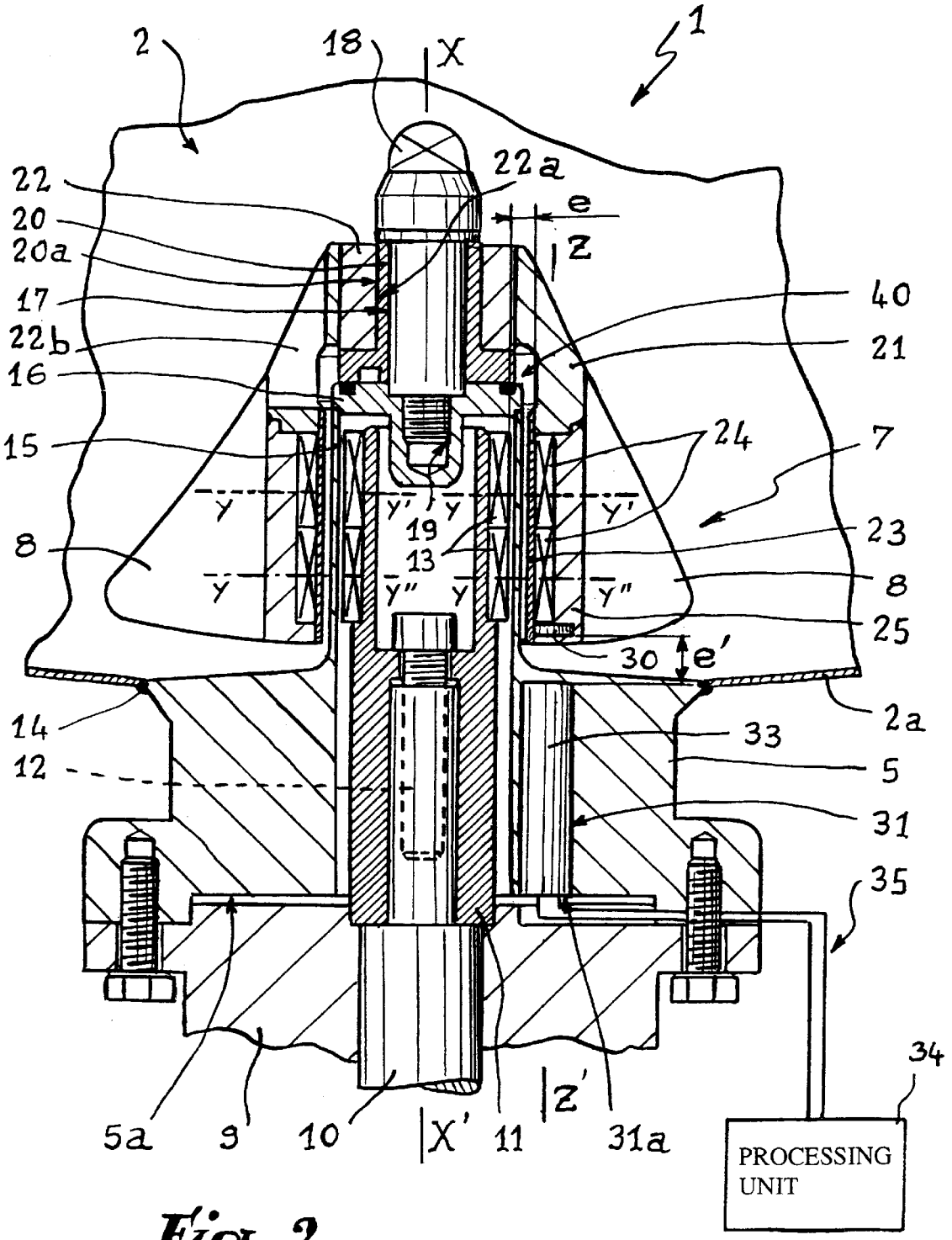
FIG. 2 is a view on a larger scale of detail II of FIG. 1, the agitator being shown in section.

A bevel gear 9 is disposed at the outlet of the motor 6 and its driven shaft is constituted by a shaft 10 partially visible in FIG. 2. This shaft 10 is secured to a hollow shaft 11 by means of a fixing screw 12. It would also be possible to mount the motor 6 in direct engagement on a shaft 10, the use of a bevel gear not being indispensable.

The hollow shaft 11 bears two rows of permanent magnets 13 regularly distributed on the periphery of the shaft 1. The North-South polarity of the magnets 13 is directed in directions Y-Y' or Y-Y" substantially perpendicular to axis X-X'. In this way, the rotation of the shaft 10 by the motor 6 results in a rotation of the magnets 13 about axis X-X', while their respective lines of polarity are oriented perpendicularly with respect to this axis.

The collar 5 is mounted on the wall 2*a* of the tank 2 via a welding bead 14, with the result that the assembly thus produced is tight. The collar 5 is shaped as a sleeve 15 whose end is obturated by a plate 16 welded on the sleeve 15. In this way, the assembly between the sleeve 15 and the plate 16 is tight. Taking into account the fixation of the plate 16 on the sleeve 15, the latter is blind in that it does not open out inside the tank 2.

A bearing 17 is mounted on the plate 16 by means of a screw 18 received in a blind tapping 19 in plate 16. The bearing 17 carries a ring 20 whose outer surface 10*a* constitutes a bearing surface. The propelling screw 7 comprises a head 21 formed by a ring 22 whose inner circular surface 22*a* is intended to fit around the surface 20*a* of the ring 20. A smooth bearing is thus produced by smooth contact, for example metal/metal, between surfaces 20*a* and 22*a*.

Three arms 22*b* regularly distributed on the periphery of the ring 22 extend radially therefrom towards the outside and support a bush 23 disposed around the blind sleeve 15, radially outside same. This bush 23 bears, on its outer surface, two rows of permanent magnets 24 disposed opposite the magnets 13 carried by the hollow shaft 11. The North-South polarity of the magnets 24 is oriented in directions Y-Y' or Y-Y". An added piece 25, made of stainless steel, is disposed outside the magnets 24 in order to constitute, with the bush 23, a cylindrical sleeve on which the blades 8 of the propelling screw 7 can be welded.

Taking the foregoing into account, the rotation of the hollow shaft 11 results in a rotation of the magnets 13, which, in view of the magnetic field created between these magnets 13 and the corresponding magnets 24, has for its effect to exert on the propelling screw 7 a torque of the same direction as the direction of rotation of the shaft 11 about axis X-X'. The propelling screw 7 is thus driven in rotation about axis X-X', without direct mechanical contact between the shaft 11 and the screw 7.

A permanent magnet 30 is disposed in the bottom of the piece 25, i.e. on the side of this piece directed towards the collar 5. The North-South polarity of the magnet 30 is disposed in a direction Z-Z' substantially parallel to axis X-X'. In the collar 5, there is provided a blind bore 31 whose opening 31*a* is disposed at the level of an outer surface 5*a* of the collar, i.e. a surface turned towards the bevel gear 9. A measurement cell 33 adapted to detect the proximity of the magnet 30 is installed in the bore 31. An air gap e' is defined between the magnet 30 and the cell 33. In this air gap there is created, upon each passage of the magnet 30 opposite the cell 33, a transitory magnetic field which may be detected by the cell 33 and transformed into an output signal or "blip" which may be transmitted to a processing unit 34 by an electrically conducting cable 35.

Functioning is as follows:

When the propelling screw 7 is set into motion thanks to the cooperation of magnets 13 and 24, magnet 30 passes, at each turn, opposite the cell 33 which detects this passage thanks to a variation of the magnetic field created in the temporary air gap e, for example by creation of an eddy current in the cell 33. In this way, the effective rotation of the propelling screw 7 is detected by the cell 33.

The intense electromagnetic field created at the level of an air gap e between the magnets 13 and 24 through the sleeve 15 and the bush 23 does not disturb the electromagnetic field prevailing temporarily in the air gap e', as the electromagnetic field created in the air gap e is closed by the magnets 13 and 24. In addition, the electromagnetic field prevailing between the magnets 13 and 24 extends in an essentially radial direction, about axis X-X', while the temporary electromagnetic field created between the magnet 30 and the cell 33 extends in a direction substantially parallel to direction Z-Z'.

As the bore 31 is blind, there is no contact between the mixture 3 and the cell 33, this avoiding any risk of pollution of the mixture and any risk of soiling the cell.

The pieces visible in FIG. 2 are principally made of an a magnetic material, for example stainless steel, in order not to disturb the electromagnetic fields created between the magnets 13 and 24 or between the magnet 30 and the cell 33.

It should be noted that the added piece 25 might be eliminated if the bush 23 were made by overmoulding of the magnets 24 and 30.

The invention has been described with a single magnet 30, but it is possible to use a plurality of magnets regularly distributed about axis X-X', this rendering the measuring chain made with the cell 33 more precise.

The unit 34 is advantageously provided in order to determine, by computing, the speed of rotation of the propelling screw 7, which is easy since it suffices to count the number of blips received from the cell 33 during an interval of time. The invention therefore produces a speedometer for a magnetically driven agitator.

An annular space 40 is made between the arms 22*b* of the head 31 of the propelling screw 7 and the bearing 17, which enables said screw 7 to be easily cleaned, including when it is maintained in position on the blind sleeve 15, i.e. without dismantling said propelling screw.

Any type of cell for detection by magnetic effect may be used with the agitator of the invention.

The invention has been shown with two rows of magnets 13 and 24. However, the number and distribution of these magnets are variable. They may be disposed in one row or, on the contrary, in more than two rows, as a function of the torque to be transmitted and of the geometry of the propelling screw.

What is claimed is:

1. Magnetically driven agitator for a mixture contained in a recipient, comprising; an agitator supported by a collar hermetically mounted in a wall of the recipient, said collar including a blind sleeve inside which is housed a drive shaft provided with a first magnetic coupling means, a propelling screw disposed about said sleeve and provided with a second magnetic coupling means adapted to cooperate with said first magnetic coupling means for driving said propelling screw about an axis of rotation, said propelling screw including a third magnetic coupling means disposed opposite a cell for detecting the movement of said third coupling means relative thereto, and said cell being carried by said collar.

2. The agitator of claim 1, wherein said third magnetic coupling means comprises at least one permanent magnet.

3. The agitator of claim 1, wherein an air gap between said third coupling means and said detection cell is substantially perpendicular to the axis of rotation of said propelling screw.

4. The agitator of claim 3, wherein said first an second coupling means form a magnetic field extending in an essentially radial direction about said axis of rotation of said propelling screw, and a magnetic field created between said third coupling means and said detection cell being substantially parallel to said axis of rotation.

5. The agitator of claim 4, wherein said propelling screw includes a bush and surrounding piece defining a sleeve for mounting said second and third coupling means, said sleeve being placed around said blind sleeve, and said third coupling means being oriented towards said detection cell.

6. The agitator of claim 1, wherein said first and second magnetic coupling means each comprise at least one permanent magnet of which the direction of bias is oriented radially with respect to said blind sleeve.

7. The agitator of claim 6, wherein said third magnetic coupling means comprises at least one permanent magnet disposed so that its direction of bias is substantially perpendicular to the direction of bias of said at least one permanent magnet of the first and second coupling means.

8. The agitator of claim 1, wherein an output signal of said detection cell is furnished to a processing unit adapted to determine from said signal, by computing, a speed of rotation of said propelling screw.

9. The agitator of claim 1, wherein said collar comprises a blind housing for accommodating said detection cell, an opening of said housing facing towards an outside of said collar.

10. The agitator of claim 1, wherein said propelling screw comprises a plurality of blades distributed around a bushy a head provided with a plurality of arms supporting said bush, and an annular space between said arms and a terminal part of said blind sleeve.

* * * * *